US005390372A

United States Patent [19]

Hashimoto et al.

[11] Patent Number: 5,390,372

[45] Date of Patent: Feb. 21, 1995

[54] GOLF GLOVE WITH MESH LINING

[75] Inventors: Kenichi Hashimoto, Tsuruga; Shinichi Hata, 40-66-1, Echizen-cho, Kuriya, Nyu-gun, Fukui-ken, both of Japan

[73] Assignee: Shinichi Hata, Fukui, Japan

[21] Appl. No.: 769,503

[22] Filed: Oct. 1, 1991

Related U.S. Application Data

[63] Continuation-in-part of Ser. No. 519,527, May 4, 1990, abandoned.

[30] Foreign Application Priority Data

May 8, 1989 [JP] Japan ..... 1-53294[U]

[51] Int. Cl.[6] ..... A41D 19/00

[52] U.S. Cl. ..... 2/161.2; 2/164

[58] Field of Search ..... 2/164, 161 A, 163, 16, 2/20, 159, 160, 161.1, 161.2, 161.3, 161.6, 161.8, 162, 164

[56] References Cited

U.S. PATENT DOCUMENTS

| | | | |
|---|---|---|---|
| 325,968 | 9/1885 | Rawlings | 2/164 X |
| 482,647 | 9/1892 | Obear | 2/164 X |
| 723,348 | 3/1903 | Wilkens | 2/164 |
| 1,083,795 | 1/1914 | Brokaw | 2/164 X |
| 1,346,683 | 7/1920 | Reynolds | 2/164 X |
| 1,475,221 | 11/1923 | Cleveland | 2/164 X |
| 2,309,476 | 1/1943 | Patterson, Jr. | 2/159 |
| 2,566,580 | 9/1951 | Patterson, Jr. | 2/159 |
| 2,858,542 | 11/1958 | Ogg | 2/161 A |
| 3,548,413 | 12/1970 | Jackson | 2/164 X |
| 3,916,448 | 11/1975 | Hamel | 2/164 X |
| 4,095,292 | 6/1978 | Klein | 2/164 X |
| 4,984,301 | 1/1991 | Jordan, Jr. | 2/164 X |

FOREIGN PATENT DOCUMENTS

| | | | |
|---|---|---|---|
| 0346686 | 11/1989 | European Pat. Off. | 2/159 |
| 7658 | of 1893 | United Kingdom | 2/164 |
| 16945 | of 1903 | United Kingdom | 2/159 |

*Primary Examiner*—Clifford D. Crowder
*Assistant Examiner*—Michael A. Neas
*Attorney, Agent, or Firm*—Edwin E. Greigg; Ronald E. Greigg

[57] ABSTRACT

In a golf glove made of leather, a mesh-cloth is mounted or attached to at least a portion of the inside of the glove body corresponding to the plam and portions of the inside thereof corresponding to the bulb of each of the four fingers except the thumb.

6 Claims, 3 Drawing Sheets

GOLF GLOVE WITH MESH LINING

This is a continuation-in-part of application(s) Ser. No. 07/519,527, filed on May 4, 1990, now abandoned.

BACKGROUND OF THE INVENTION (1) Field of the Invention

The present invention relates to a golf glove and more particularly to a golf glove which is made of natural or synthetic leather and which includes a mesh cloth or a lace on the inside of the groove.

(2) Description of the Prior Art

Generally, a golf glove which is made of natural or synthetic leather is widely used. However, such a golf glove has a drawback that a hand or hands tend to slip on a golf club while playing golf. As result, it is hard for a golf player to swing a golf club smoothly and accurately.

A number of ideas have been proposed in order to prevent such a slip occurring between the hands and a golf club. Such ideas are all the same. Namely, they try to prevent such a slip by increasing a friction between the surface of the golf glove and the golf club.

According to my research, it has been found that such a slip occurs between not only the surface of the golf glove and the golf club, but also the palm of the hand and the inside of the golf glove when the hand sweats. Such a slip between the palm of the hand and the golf glove has a great influence on the swing of the golf club and it sometimes prevents accurate swing of the golf club.

SUMMARY OF THE INVENTION

It is an object of the present invention to provide a golf glove which enables a golf player to swing accurately .and to play golf smoothly by preventing a slip between the hand and the golf glove due to sweat.

In order to achieve the above object, a golf glove according to the present invention comprises a glove body made of leather, and a mesh-cloth or lace mounted on the inside of the glove body, said mesh-cloth or lace being positioned on at least a portion of the glove body corresponding to the palm of a hand and also portions of the glove body corresponding to a portion of each of four fingers except the thumb.

Namely, in the present invention the mesh-cloth, or lace, which prevents slippage when wet with sweat, is arranged at least on the inside of the portion of the glove body corresponding to the palm and the insides of the glove body corresponding to a portion of each of the four fingers except the thumb so that slip between the golf glove and the hand may be prevented so as to-avoid displacement of the hand position on the grip of a golf club. As result, the present invention has an advantage of swinging the golf club smoothly and accurately so that the golf club becomes stable without slippage of the groove on the hand. Another object is to provide a mesh lining for a golf glove in which the lining is formed with cotton string in the shape of a lozenge, diamond, or hexagon.

The present invention has a further advantage that since the mesh-cloth or lace absorbs some sweat, the glove body made of leather becomes wet a little and thereby slip between the glove body and the grip of the golf club may be prevented.

Further advantages of the present invention will be apparent from the description of an embodiment with reference to the drawings.

BRIEF DESCRIPTION OF THE DRAWINGS

The drawings show an embodiment of a golf glove according to the present invention in which.

DETAILED DESCRIPTION OF THE EMBODIMENT

Figure 1:
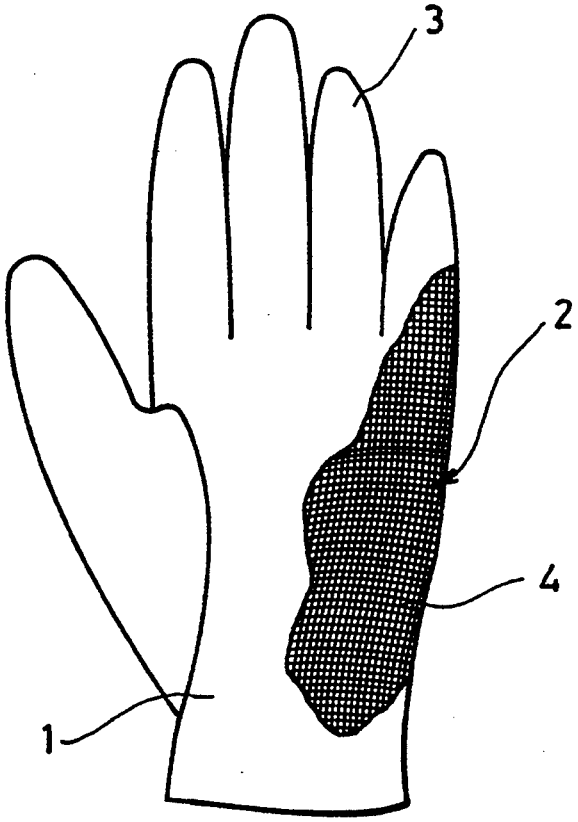
FIG. 1 is a front view of a golf glove partly broken away.

As shown in FIG. 1, 1 shows a glove body of a golf glove made of leather. A mesh-cloth 4 such as made by a cord that forms a strong twilled cloth which is attached or mounted onto at least the inside of a portion 2 of the glove body corresponding to the palm of a hand and also the insides of a portion of each of four fingers 1 except the thumb.

The mesh-cloth 4 is overlaid on the glove body 1 made of leather and sewn up together around the portions 2 corresponding to the palm when the glove body 1 is made.

However, it is possible to adhere the mesh-cloth 4 to the glove body 1. In this case, though pliability of the leather forming the glove body 1 is reduced, the object of the present invention may be achieved.

Normally, a portion of a golf glove corresponding to the palm and the portions corresponding to the portions of the four fingers except the thumb are frequently made with a single sheet of leather. Therefore, the mesh-cloth 4 is formed in substantially the same shape as that of the leather sheet and when the glove body is made, the leather sheet may be sewn up together with the mesh-cloth at their peripheries so that the golf glove of the present invention may be easily manufactured.

In the above-mentioned embodiment, the mesh-cloth 4 may be positioned or placed on the whole of the inside of the glove body 1. In such a case, a glove is first made with the mesh-cloth 4 and the mesh-cloth glove is inserted into the inside of the glove body 1 made of leather and then these gloves may be sewn up at its portion corresponding to a wrist.

The mesh-cloth 4 may be selected from a group of ordinary synthetic fibers such as polyester, nylon and the like, but it is preferable to use cotton or rayon which is rich in hygroscopicity, or synthetic fibers which have a tendency to absorb sweat or water.

Further, although the glove body 1 is made of leather, it may use synthetic leather other than natural leather.

Figure 2:
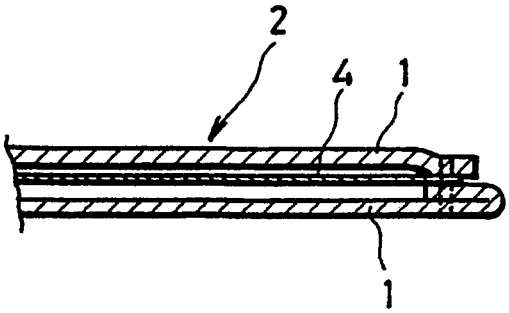
FIG. 2 is a sectional view on the line A—A in FIG. 1.
Figure 3:
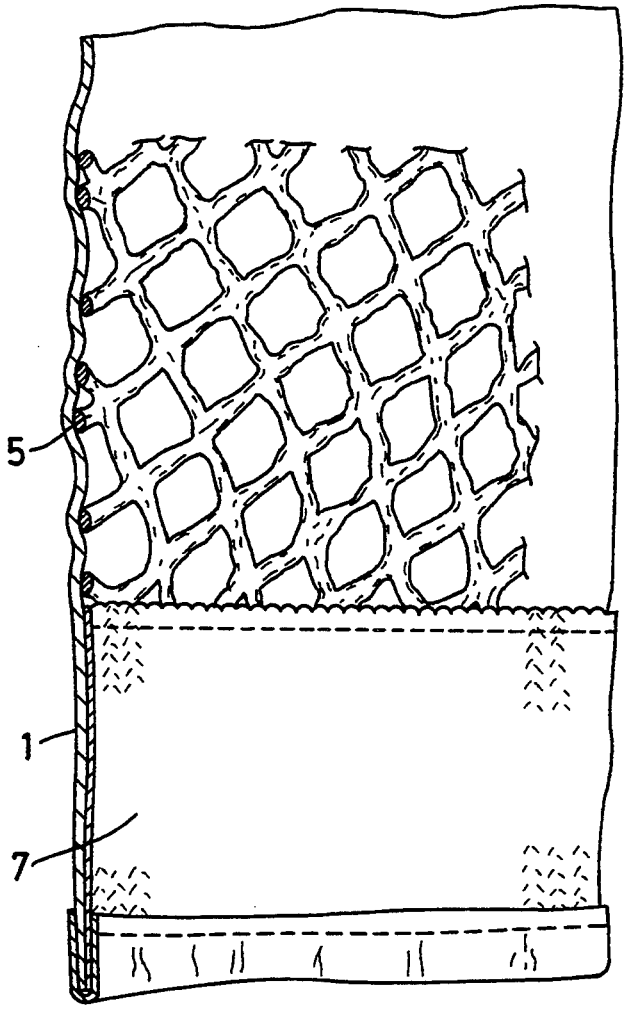
FIG. 3 illustrates a portion of a glove illustrating a mesh-cloth or a lace material on the inner surface of the glove with the mesh shown as a diamond shape.
Figure 4:
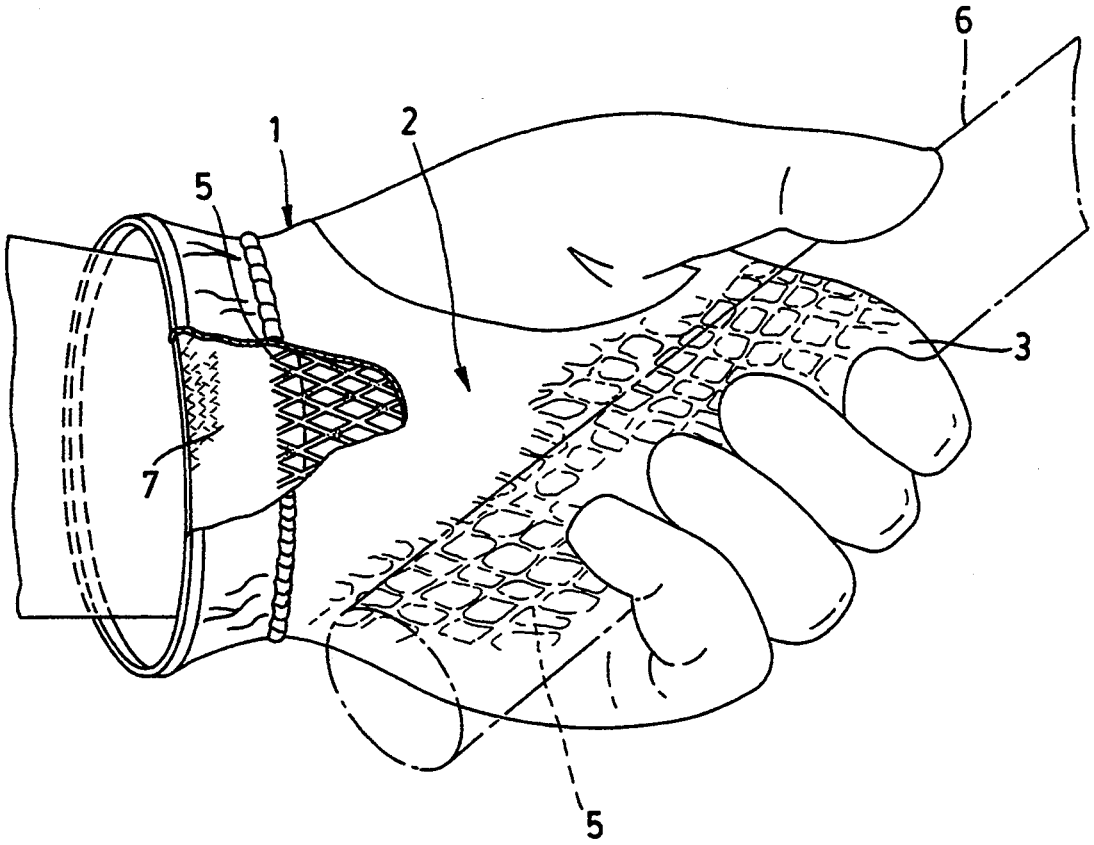
FIG. 4 illustrates a partial cutaway showing the lace on the inside of the glove with the lace and golf club shown in phantom.

FIGS. 3 and 4 show a modification of the golf glove shown in FIGS. 1 and 2. The modification involves replacing the mesh-cloth 4 with a lace material 5 which includes openings in the shape of a diamond or a hexagon. The lace is formed with a cotton thread or string. If the opening is made as a diamond, one diagonal line may be from about 5 mm to about 7 mm and another diagonal line may be from about 3 mm to about 6 mm.

Of course, if it is shaped as a diamond or a hexagon, the thread lengths are the same.

The lace as shown in FIGS. 3 and 4 is applied on the inside of the glove as set forth above for FIGS. 1 and 2. Since the mesh cloth or lace is formed by cotton thread, the thread will absorb some sweat and when the hand grips the club 6, the thread will be impressed into the palm of the hand and into the inner surface of the leather glove to prevent any slippage of the glove on the hand. Therefore, the size of the mesh and the size of the cotton string are important to provide a good grip on the club. The lace has the form of a marquisette.

AS shown in FIGS. 3 and 4, the lace is secured to an inner material 7 which is secured to the inner surface of the wrist portion of the glove thereby forming a covering on the inside of the golf glove near the opening and may be secured to the inner surface of the glove fingers that cover the inside surface of a portion of the fingers when making the glove. Thus, the lace will remain in place and provide means for preventing hand slippage during a golf club swing.

What is claimed is:

1. A golf glove comprising:

a glove body made of leather, said glove body includes a wrist portion, a hand portion, a palm portion including finger portions, and a thumb portion which covers a front side and back side of one's hand, a sweat-absorbing non-slip lace material mounted on and secured to an inside surface of the glove body, said lace material being positioned only on a portion of the glove body starting at the wrist portion and covering the palm portion of a wearer's hand and also covering portions of the glove body extending from the palm portion and covering a front portion of each of one's four fingers and extending to the thumb portion but not covering a portion of the thumb, said lace material having an open mesh in the shape of a diamond in which said diamond shape has a longer diagonal line in a direction from the wrist toward the fingers than in a direction from the thumb portion across the fingers.

2. A golf glove as set forth in claim 1 in which the lace is formed of a cotton thread with the thread length forming each side of the diamond mesh being at least 3 mm in length.

3. A golf glove as set forth in claim 1 in which the lace is formed of a cotton thread with the thread length forming each side of the diamond mesh being from about 3 mm to about 7 mm.

4. A golf glove as set forth in claim 1 wherein said lace material is fixed to an inside surface of said glove.

5. A golf glove as set forth in claim 2 wherein said lace material is fixed to an inside surface of said glove.

6. A golf glove as set forth in claim 3 wherein said lace material is fixed to an inside surface of said glove.

* * * * *